US005738028A

United States Patent [19]

Wang

[11] Patent Number: 5,738,028

[45] Date of Patent: Apr. 14, 1998

[54] DIFFERENTIAL FEEDING DEVICE FOR SEWING MACHINE

[76] Inventor: Shui Nu Wang, No. 6, Nan Pin Road, Taichung, Taiwan

[21] Appl. No.: 807,360

[22] Filed: Feb. 27, 1997

[51] Int. Cl.[6] ..... D05B 27/08

[52] U.S. Cl. ..... 112/313

[58] Field of Search ..... 112/313, 312, 112/314, 303

[56] References Cited

U.S. PATENT DOCUMENTS 3,611,817 10/1971 Smith ..... 112/313

5,103,751 4/1992 Wang ..... 112/314

*Primary Examiner*—Peter Nerbun

*Attorney, Agent, or Firm*—Charles E. Baxley, Esq.

[57] ABSTRACT

A differential feeding device for a sewing machine includes a spindle and a shaft. A cam is fixed on the spindle and two followers are engaged on the cam for allowing the cam to move the followers up and down. A lever is fixed on the shaft and has one end pivotally coupled to one of the followers and has the other end pivotally coupled to a lower end of another lever which has a groove and which has an upper end pivotally coupled to the other follower. A block is slidably received in the groove and moved along the groove for adjusting the relative movement between the followers.

1 Claim, 3 Drawing Sheets

DIFFERENTIAL FEEDING DEVICE FOR SEWING MACHINE

BACKGROUND OF THE INVENTION (a) Field of the Invention

The present invention relates to a feeding device, and more particularly to a differential feeding device for a sewing machine.

(b) Description of the Prior Art

The closest prior art of which applicant is aware is his prior U.S. Pat. No. 5,069,152 to Wang and U.S. Pat. No. 5,103,751 to Wang. The feeding device may be used for differential feeding the cloth. It is required to provide many more functions for the sewing machine in order to benefit the users and for attracting the user to buy and to use the sewing machine. However, the lever of the typical sewing machine occupies a large volume such that the other elements may not be easily engaged into the sewing machine and such that the lever is required to be modified for accommodating more elements into the sewing machine.

The present invention has arisen to mitigate and/or obviate the afore-described disadvantages of the conventional sewing machines.

SUMMARY OF THE INVENTION

The primary object of the present invention is to provide a differential feeding device for a sewing machine in which the adjusting mechanism includes a simplified configuration for allowing more elements to be engaged into the sewing machine.

In accordance with one aspect of the present invention, there is provided a differential feeding device for a sewing machine comprising a spindle and a shaft rotatably supported in parallel to each other, a first cam and a second cam fixed on the spindle, a first guide and a second guide rotatably engaged on the first cam and the second cam respectively and each including a square outer shape, a first follower including a first rectangular opening for slidably receiving the first guide and for allowing the first cam to move the first follower up and down, the first follower including a first end and a second end, a plate rotatably supported at a stud and including a slot, a first block pivotally coupled to the first end of the first follower and slidably received in the slot of the plate, means for rotating the plate and for adjusting an inclination of the slot, a second follower and a third follower each including a first end and a second end, and each including a first rectangular opening for slidably receiving the second guide and for allowing the second cam to move the second follower and the third follower up and down, the third follower including a middle portion having an oblong hole, two pawls secured on the first ends of the second and the third followers respectively, a first lever and a second lever each including a middle portion secured to the shaft, the first lever including a first end pivotally coupled to the second end of the first follower for allowing the first follower to swing the shaft and the first lever and the second lever, the second lever including a first end pivotally coupled to the second end of the second follower at a pin and including a second end, the pin being slidably engaged in the oblong hole of the third follower for allowing the third follower to be moved relative to the second follower, a third lever including a first end pivotally coupled to the second end of the third follower and including a middle portion having a groove, the third lever including a second end pivotally coupled to the second end of the second lever, a second block slidably receiving in the groove of the third lever for allowing the second lever to rotate the third lever about the second block, and means for moving the second block along the groove of the third lever and for adjusting relative movement between the second and the third followers. The second block is slidably engaged in the groove of the third lever such that the length of the third lever may be shortened and such that a number of elements may be eliminated. The sewing machine may thus include an increased space for accommodating more elements for facilitating the operating functions of the sewing machine.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
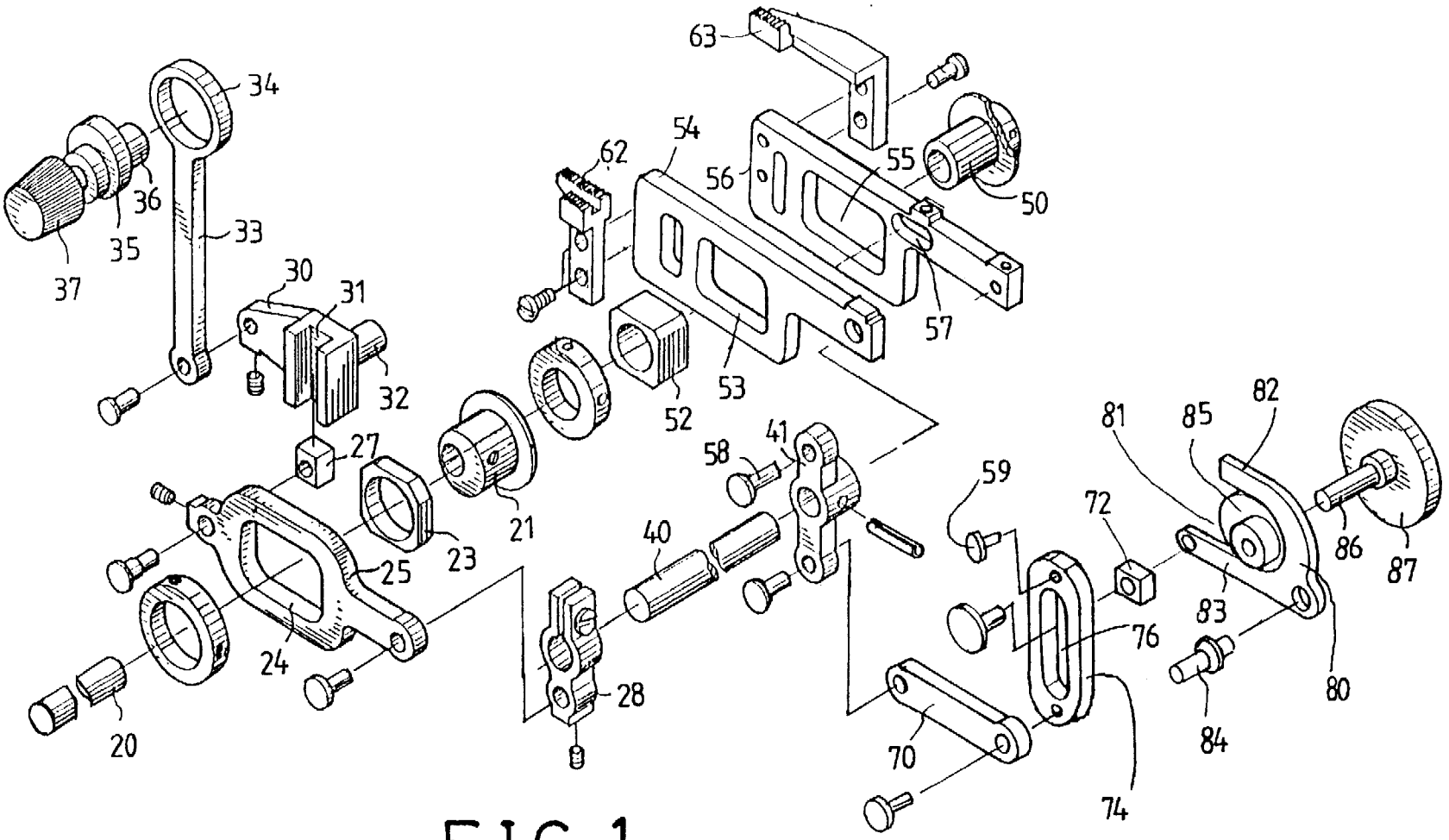
FIG. 1 is an exploded view of a differential feeding device for a sewing machine in accordance with the present invention.
Figure 2:
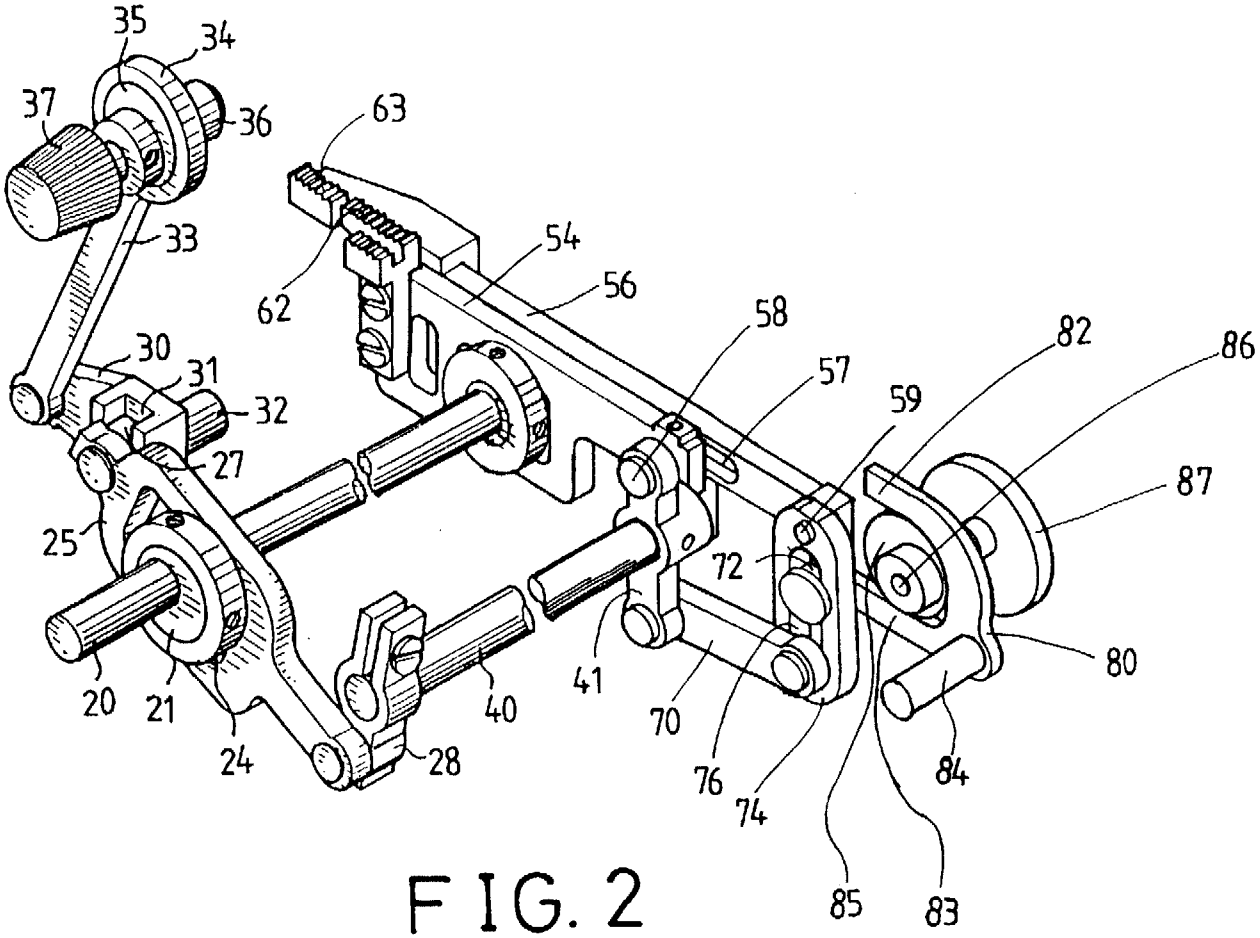
FIG. 2 is a perspective view of the differential feeding device.
Figure 3:
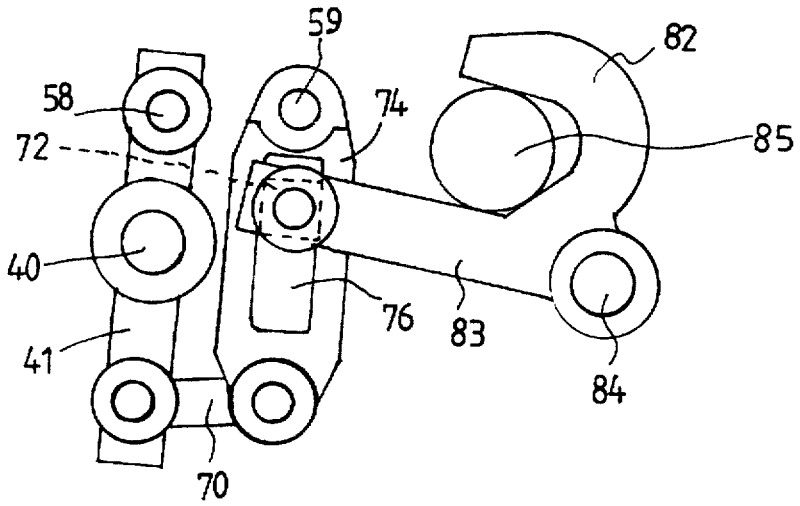
FIGS. 3 and 4 are schematic views illustrating the operation of the differential feeding device.
Figure 4:
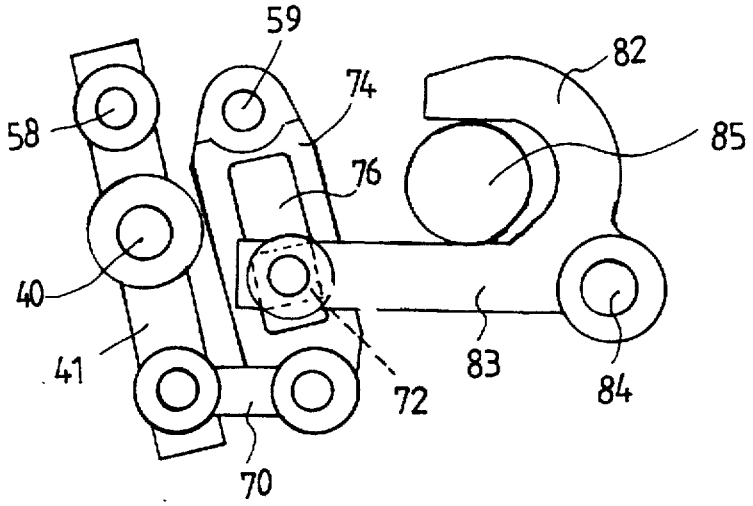

Referring to the drawings, and initially to FIGS. 1–3, a differential feeding device in accordance with the present invention is provided for feeding the cloth differentially and comprises a spindle 20 and a shaft 40 rotatably supported in parallel in the sewing machine. A cam 21 is fixed on one end of the spindle 20 and rotates in concert with the spindle 20. A square guide 23 is rotatably engaged on the cam 21 and slidably received in a rectangular opening 24 of a follower 25 for allowing the cam 21 to move the follower 25 up and down. Two levers 28, 41 are fixed on the shaft 40. A block 27 is pivotally coupled to one end of the follower 25, and the other end of the follower 25 is pivotally coupled to the lower end of the lever 28 for swinging the lever 28 and the shaft 40. The block 27 is slidably engaged in a slot 31 of a plate 30 which is pivotally secured in the machine 10 at a stub 32 and which is pivotally coupled to a lower end of an arm 33. The arm 33 has a ring 34 formed on top for engaging with a cam 35 which is fixed on an axle 36, and for allowing the cam 35 to move the arm 33 up and down and down. A knob 37 is fixed to the axle 36 for rotating the axle 36 and for moving the arm 33 up and down. The arm 33 may be moved up and down by the cam 35 for rotating the inclination of the plate 30 and the slot 31; and the follower 25 may be moved up and down by the cam 21 in order to adjust the swinging amplitude of the lever 28 and the lever 41.

A cam 50 is fixed on the other end of the spindle 20 and rotates in concert with the spindle 20. A guide 52 which has a square outer shape is rotatably engaged on the cam 50 and slidably received in both rectangular openings 53, 55 of two followers 54, 56 for allowing the cam 50 to move the followers 54, 56 up and down. Two pawls 62, 63 are secured to the front ends of the respective followers 54, 56 and arranged to be moved relative to each other when the followers 54, 56 move forward and backward relative to each other. The upper end of the lever 41 is pivotally coupled to the rear end of the follower 54 by a pin 58 which is engaged through an oblong hole 57 of the follower 56 for allowing the lever 41 to move the follower 54 back and forth by the swinging movement of the lever 41. The sliding engagement of the pin 58 in the oblong hole 57 of the follower 56 allows the followers 54 and 56 to be moved forward and backward relative to each other. The displacement of the pawls 62, 63 and thus the feeding stroke of the feeding device may be adjusted when the swinging amplitude of the lever 41 is adjusted.

A lever 74 has an upper end pivotally coupled to the rear end of the follower 56 by a pin 59 and includes a groove 76 for slidably receiving a block 72. A link 70 has one end pivotally coupled to the lower end of the lever 41 and the other end pivotally coupled to the lower end of the lever 74. A C-shaped follower 80 includes two legs 82, 83 for defining a channel 81 and includes a middle portion pivotally supported in the sewing machine at a pin 84. The front end of the leg 83 of the follower 81 is pivotally coupled to the block 72. The lever 74 is rotatable about the axis of the block 72. A cam 85 is received in the channel 81 of the follower 81 and is fixed on an axle 86 which has a knob 87 reachable from outside of the sewing machine for rotating the cam 85 and thus the follower 80 such that the block 72 may be moved along the groove 76 of the lever 74.

In operation, the pawl 62 can be moved back and forth directly by the lever 41, and the pawl 63 can be moved back and forth by the lever 41 via the link 70 and the lever 74. The block 72 may be moved up and down along the groove 76 for adjusting the swinging amplitude of the upper end of the lever 74 and thus for adjusting the relative moving stroke between the pawls 62, 63 such that the cloth retained by the pawls 62, 63 will be stretched by the pawls or will be formed with wrinkles. It is to be noted that the block 72 is slidably engaged in the groove 76 of the lever 74 such that the length of the lever 74 may be shortened and such that the sewing machine may include a simplified configuration for allowing more elements to be engaged into the sewing machine. The space thus increased may be used for engaging with elements that may be used for increasing the function of the sewing machine.

Accordingly, the differential feeding device in accordance with the present invention may form wrinkles in cloth and may stretch elastic articles. The device includes a simplified configuration for allowing more elements to be engaged into the sewing machine.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A differential feeding device for a sewing machine comprising:

a spindle and a shaft rotatably supported in parallel to each other, a first cam and a second cam fixed on said spindle, a first guide and a second guide rotatably engaged on said first cam and said second cam respectively and each including a square outer shape, a first follower including a first rectangular opening for slidably receiving said first guide and for allowing said first cam to move said first follower up and down, said first follower including a first end and a second end, a plate rotatably supported at a stud and including a slot, a first block pivotally coupled to said first end of said first follower and slidably received in said slot of said plate, means for rotating said plate and for adjusting an inclination of said slot, a second follower and a third follower each including a first end and a second end, and each including a first rectangular opening for slidably receiving said second guide and for allowing said second cam to move said second follower and said third follower up and down, said third follower including a middle portion having an oblong hole, two pawls secured on said first ends of said second and said third followers respectively, a first lever and a second lever each including a middle portion secured to said shaft, said first lever including a first end pivotally coupled to said second end of said first follower for allowing said first follower to swing said shaft and said first lever and said second lever, said second lever including a first end pivotally coupled to said second end of said second follower at a pin and including a second end, said pin being slidably engaged in said oblong hole of said third follower for allowing said third follower to be moved relative to said second follower, a third lever including a first end pivotally coupled to said second end of said third follower and including a middle portion having a groove, said third lever including a second end pivotally coupled to said second end of said second lever, a second block slidably receiving in said groove of said third lever for allowing said second lever to rotate said third lever about said second block, and means for moving said second block along said groove of said third lever and for adjusting relative movement between said second and said third followers.

* * * * *